US005228832A

United States Patent [19]

Nishida et al.

[11] Patent Number: 5,228,832

[45] Date of Patent: Jul. 20, 1993

[54] MIXED FLOW COMPRESSOR

[75] Inventors: Hideo Nishida; Hiromi Kobayashi; Haruo Miura, all of Ibaraki; Takeo Takagi, Tsukuba, all of Japan

[73] Assignee: Hitachi, Ltd., Tokyo, Japan

[21] Appl. No.: 920,172

[22] Filed: Jul. 27, 1992

Related U.S. Application Data

[63] Continuation of Ser. No. 668,130, Mar. 12, 1991, abandoned.

[30] Foreign Application Priority Data

Mar. 14, 1990 [JP] Japan ..... 2-060973

[51] Int. Cl.[5] ..... F04D 29/44

[52] U.S. Cl. ..... 415/208.1; 415/208.3; 415/211.2

[58] Field of Search ..... 415/208.1, 208.2, 208.3, 415/211.2, 198.1, 199.1, 199.2

[56] References Cited

U.S. PATENT DOCUMENTS

| | | | |
|---|---|---|---|
| Re. 32,462 | 7/1987 | Yoshinaga et al. | 415/208.3 |
| 865,863 | 9/1907 | Buhle | 415/208.3 |
| 3,771,925 | 11/1973 | Friberg et al. | 415/208.3 |
| 3,832,089 | 8/1974 | Moellmann | 415/211.1 |
| 4,224,010 | 9/1980 | Fujino | 415/199.2 |
| 4,395,197 | 7/1983 | Yoshinaga et al. | 415/208.3 |
| 4,850,795 | 7/1989 | Bandukwalla | 415/208.4 |
| 4,900,225 | 2/1990 | Wulf et al. | 415/224.5 |
| 4,902,200 | 2/1990 | Bandukwalla et al. | 415/914 |
| 5,062,766 | 11/1991 | Miura et al. | 415/199.1 |

FOREIGN PATENT DOCUMENTS

| | | | |
|---|---|---|---|
| 201912 | 5/1986 | European Pat. Off. . | |
| 56-38240 | 3/1981 | Japan . | |
| 198798 | 8/1988 | Japan | 415/211.1 |
| 125764 | 8/1949 | Sweden | 415/100 |
| 693727 | 7/1953 | United Kingdom . | |

OTHER PUBLICATIONS

Compressed Air Magazine, vol. 9, Sep. 1985, "The X-Flo Compressor, etc." pp. 30-34.

"Proceedings of the Sixth Turbomachinery Symposium", (Oct. 1977), pp. 61-62.

*Primary Examiner*—John T. Kwon

*Attorney, Agent, or Firm*—Antonelli, Terry, Stout & Kraus

[57] ABSTRACT

A compressor is disclosed are disposed in which a diffuser flow passage is curved to a radial direction in the vicinity of an outlet of a mixed-flow impeller, and guide vanes are disposed in which each is of a height (projecting into the diffuser flow passage in a direction substantially transverse to the direction of flow) that is less than the meridional flow passage width such that the minimum inlet radius is larger than a maximum radius at the outlet of the mixed-flow impeller and are arranged in the form of a circular cascade at the curved portion on a flow passage surface of the diffuser plate located on a shroud side. Thus, it is possible to keep uniform the flow within the diffuser and to enhance the performance of the compressor. In addition, the axial length of the compressor may be shortened to thereby make the compressor compact in size.

24 Claims, 5 Drawing Sheets

MIXED FLOW COMPRESSOR

This application is a continuation of application Ser. No. 07/688,130, filed Mar. 12, 1991, abandoned.

BACKGROUND OF THE INVENTION

1. Field of the Invention

The present invention relates to a mixed-flow compressor, and more particularly to a mixed-flow compressor suitable for enhancement of its performance and for compactness in size.

2. Description of the Prior Art

As disclosed in Proceedings of the Sixth Turbomachinery Symposium, pp 61 to 62 (October 1977), in a conventional mixed-flow compressor, an oblique or mixed flow diffuser (in which a flow-out direction is leaned from the radial direction) is not provided with guide vanes in the flow path. Also, if provided as disclosed in Japanese Utility Model Examined Publication No. 56-38240, the guide vanes are arranged on a core plate side. In addition, it is also known such as in Journal of the Japan Society of Mechanical Engineers, pp 16 to 20 (March 1987) that a diffuser can be provided in the radial direction, however, guide vanes are not provided.

In general, if the specific velocity ns (expressed in the following equation) is high, an impeller inlet tip to outlet tip diameter ratio is increased, so that the performance of the impeller becomes low because the curvature of meridional flow passage is increased in the case of a centrifugal impeller. Further, because of an increase in curvature, a secondary flow becomes remarkable within the impeller, so that the flow at the outlet of the impeller is deflected to the hub side to thereby lower the performance of the diffuser. The specific speed ns is defined as:

$$ns = N \cdot \sqrt{Q} / Had^{0.75}$$

where N is the rotational speed (rpm), Q is the volume flow rate ($m^3$/min) and Had is the adiabatic head (m).

In order to avoid this problem, in general, a mixed-flow impeller in which the outlet of the impeller is leaned from the radial direction is used. In the mixed-flow impeller, the curvature of a meridional flow passage in a meridional plane (i.e., a cross section including the rotary shaft center, and (hereinafter referred simply as a meridional flow passage) is decreased, so that the flow may be kept substantially uniform in the widthwise direction at the outlet of the impeller, i.e., at the inlet of the diffuser. It is thus possible to prevent the generation of the flow deflected toward the hub side. However, if the flow having a volute component enters into the mixed-flow diffuser, the flow is deflected to the shroud side from the intermediate portion to the outlet portion of the diffuser due to the curvature which is perpendicular to the flow passage. In the extreme case, a reverse flow will be generated on the hub side to largely increase the diffuser pressure loss. In addition, in the mixed-flow compressor in which such a mixed flow diffuser without vanes is used, the length in the axial direction is increased to make the compressor large in size and to increase the friction loss in the flow passage.

Furthermore, since the length of the rotary shaft is increased, the critical speed of the rotor must be lowered.

In order to overcome these problems, guide vanes each having a height (for example, the projecting distance from a plate on a shroud side into the diffuser flow passage in a direction substantially transverse to the direction of flow) corresponding to a range from 10 to 50% of the width of the meridional flow passage and are provided on the hub side of the diffuser. However, this could no sufficiently attain the object. There are still unsolved problems such as the increase in friction loss and a reduction in critical speed.

In order to overcome these problems, an object of the present invention is to provide a mixed-flow compressor that is small in size and ensures a high performance.

SUMMARY OF THE INVENTION

This and other objects of the invention are attained by providing a mixed-flow compressor in which the in the vicinity of outlet portion of the mixed-flow impeller, i.e., in the vicinity of the inlet portion of the diffuser, the diffuser is curved to the radial direction, and the guide vanes in which each is of a height projected into the diffuser flow passage in a direction substantially transverse to the direction of flow, that is less than the meridional flow passage width) are such that the inlet and outlet vane angles are substantially equal to the impeller outlet average flow angle in design and are provided in the form of a circular cascade at the curved portion of the shroud side flow passage surface.

According to another aspect of the invention, the diffuser flow passage is curved to the radial direction just after the outlet of the impeller, and the guide vanes are such that the inlet and outlet vane angles are substantially equal to the impeller outlet average flow angle at the point of design and are provided in the form of the circular cascade just after the inlet of the flow passage surface of the diffuser on the shroud side.

With such arrangements, the following advantages are ensured.

Since each of the guide vanes has a height, projected transversely and inwardly in the diffuser flow passage, that is less than the meridional flow path width and since they are provided at the curved portion of the flow passage surface of the diffuser plate on the shroud side curved to the radial direction in the vicinity of the outlet of the mixed-flow impeller, and the inlet and outlet angles are equal to the impeller outlet average flow angle according to the design thereof turbine, the flow on the side of the side plate of the mixed-flow on the shroud side outlet is introduced into the guide vanes with almost no shock. Then, since the fluid introduced into the guide vanes is forcibly led, the fluid will flow without separating away from the wall surface of the shroud side and will reach the guide vane outlet portion. Since the vane angle is equal to the average flow angle at the design point at the guide vane outlet, i.e., the end of the curved portion, the flow angle of the fluid led by the guide vane is equal to the flow angle of the fluid at the portion where guide vanes are not provided. Also, since at the end of the curved portion, the curvature of the meridional flow passage is small, the meridional flow velocity is also kept substantially uniform in the widthwise direction. Moreover, the flow may be kept uniform in the widthwise direction.

Also, since the guide vanes each having a height as described previously are provided on the surface of the flow passage of the diffuser plate on the shroud side bent toward the radial direction and the inlet angle and the outlet angle are equal to the impeller outlet average flow angle at the point of design, the fluid of the outlet of the mixed-flow impeller on the shroud side is introduced into the guide vanes with almost no shock. Then, since the fluid introduced into the guide vanes is forcibly led by the guide vanes, the fluid will flow without separating from the wall surface of the shroud side and will reach the outlet portion of the guide vanes. Since at the outlet portion of the guide vanes, the vane angle is equal to the average flow angle of the design point, the flow angle of the fluid led by the guide vanes is equal to the flow angle of the fluid at the portion where guide vanes are not provided. Also, the curvature of the meridional plane flow passage is small at the outlet of the guide vanes so that the meridional flow velocity is also kept substantially uniform in the widthwise direction. After all, the flow is kept constant in the widthwise direction.

DESCRIPTION OF THE PREFERRED EMBODIMENTS

Figure 1:
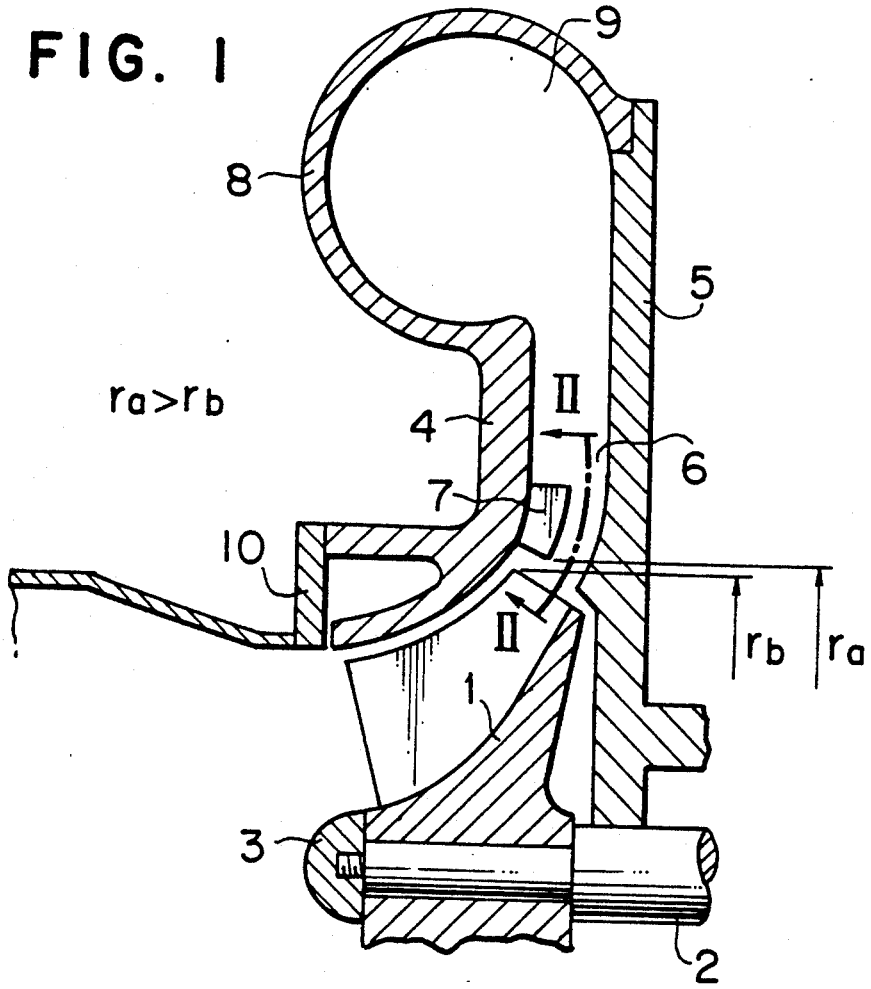
FIG. 1 is a longitudinal sectional view showing one embodiment of the invention.
Figure 2:
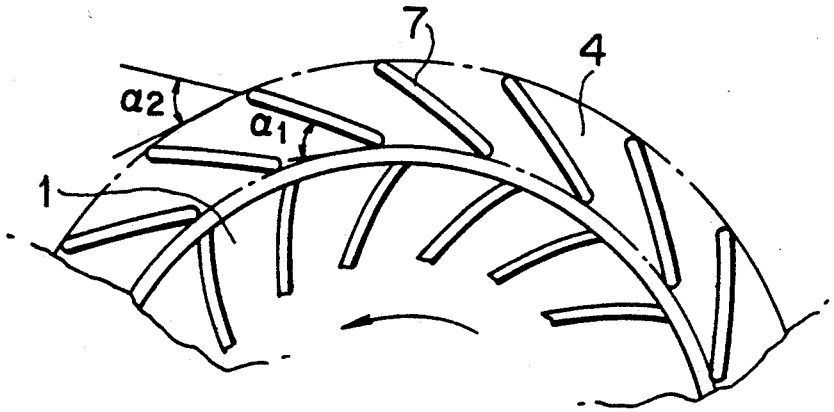
FIG. 2 is a cross-sectional view taken along the line II—II of FIG. 1.

FIG. 1 is a longitudinal sectional view showing a mixed-flow compressor in accordance with an embodiment of the invention, in which a mixed-flow impeller 1 having a small curvature in a meridional plane flow passage is fixed to a rotary shaft 2 by a nut 3. A pair of diffuser plates 4 and 5 each having a curvature in the vicinity of an outlet of the impeller 1 are provided outside of the impeller 1. The diffuser plates 4 and 5 form a diffuser 6 which has a curvature in the vicinity of the impeller 1. One of the diffuser plates 4 is located on a so-called shroud plate side, whereas the other of the diffuser plates 5 is located on a hub side. Guide vanes 7 are arranged in the form of a circular cascade at the curved portion of the flow passage surface of the diffuser plate 4. The guide vanes 7 are partially provided in the widthwise direction of the flow passage and it is preferable that their height are ranged in 20 to 50% of the flow passage width. In addition, an inlet vane angle $\alpha_1$ and an outlet vane angle $\alpha_2$ are equal to a design point of the average flow angle of the outlet of the mixed-flow impeller 1 (i.e., an average value of a fluid angle defined by an absolute velocity of the impeller outlet at the design flow rate point with respect to a tangential direction (circumferential direction)). The reason why the height of the guide vanes is in the range of 20 to 50% is that the effect of preventing reverse flow at the curved portion would be eliminated at the curved if the height is below 20% and the incidence (or shock) loss at the off-design flow rate point (i.e., a loss generated due to the difference between the flow angle and the vane angle) is increased to lower the performance of the compressor above 50% (for example, 100%).

A minimum inlet radius $r_a$ of the guide vanes 7 is larger than a maximum outlet radius $r_b$ of the impeller 1.

A casing 8 is provided radially outward of the diffuser plates 4 and 5 to define an outlet flow passage 9. A suction pipe 10 is fixed on a gas suction side of the diffuser plate 4.

The operation of the mixed-flow compressor with the above-described arrangement for compressing gas will be described.

Figure 3:
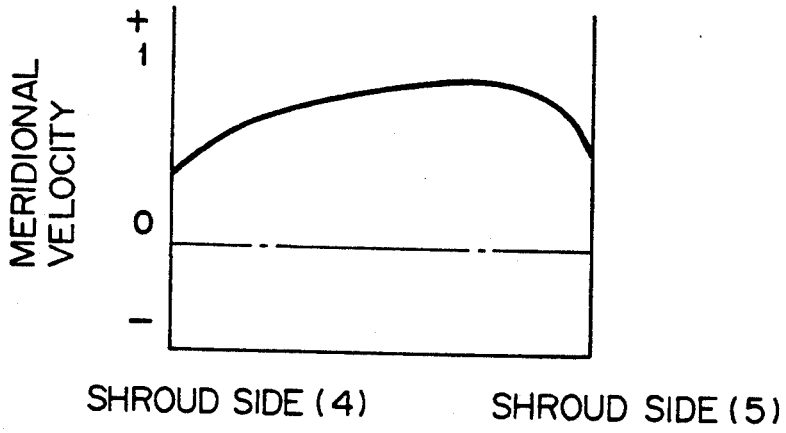
FIG. 3 is a graph showing a meridional velocity distribution in the widthwise direction at the end of the curved portion of the diffuser shown in FIG. 1.

The gas is sucked into the impeller 1 through the suction pipe 10 and then pressurized gas is discharged into the diffuser 6 from the impeller 1. The gas flow is decelerated within the diffuser 6 and is introduced into the casing 8. In general, since the curvature of the meridional flow passage of the mixed-flow impeller 1 is small, the flow at the outlet of the impeller 1 becomes uniform in the widthwise direction. Accordingly, the flow angle of the fluid on the side of the diffuser plate 4 at the outlet of the impeller 1 is substantially equal to the average flow angle in the widthwise direction, so that the fluid on the side of the diffuser plate 4 is introduced into the guide vanes 7 with almost no shock. Since the introduced fluid is forcibly guided by the guide vanes 7, the fluid may flow without separating away from the wall surface of the diffuser plate 4 and reach the outlet portion of the guide vanes 7. Since the curvature of the meridional plane flow passage is small at the outlet portion of the guide vanes 7, i.e., the terminal portion of the curvature, the flow is forcibly led by the guide vanes 7 (whose height is 40% of the diffuser 6) and becomes uniform in the widthwise direction as shown in FIG. 3.

Figure 4:
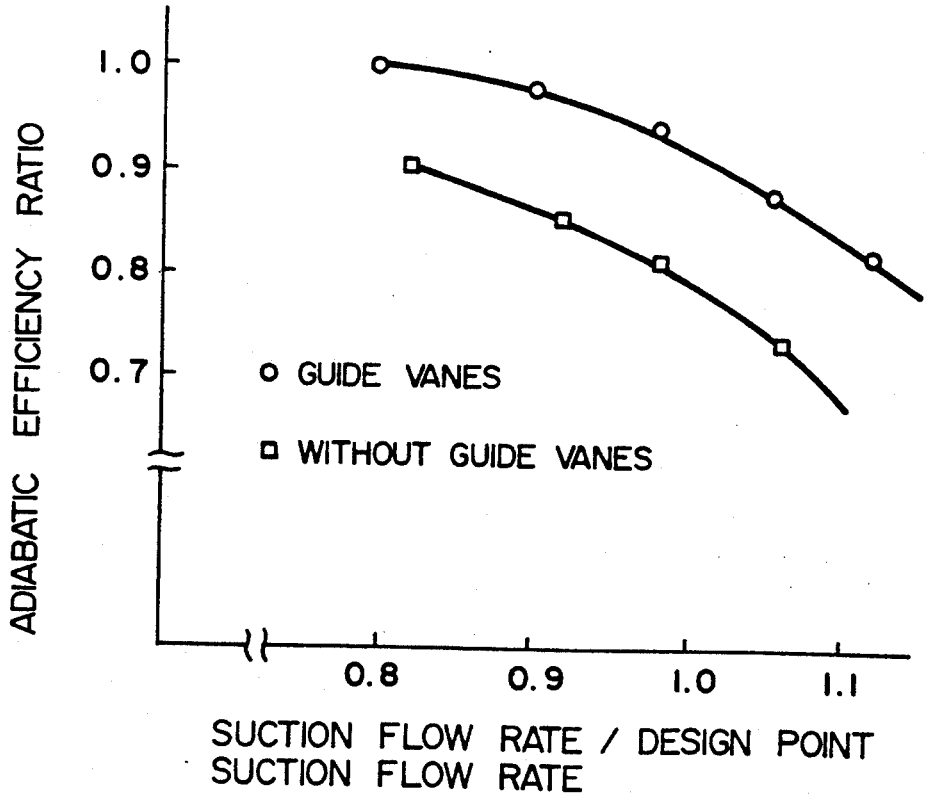
FIG. 4 is a graph showing a comparison in adiabatic efficiency ratio between the mixed-flow compressor according to the embodiment shown in FIG. 1 and a conventional mixed-flow compressor.

FIG. 4 shows the specific advantage according to this embodiment and the adiabatic efficiency ratio between a conventional mixed-flow compressor using the radially curved diffuser without any vanes and the compressor according to the present embodiment. Curve F indicates the adiabatic efficiency ratio at each suction flow rate of the conventional mixed-flow compressor, and curve E indicates the adiabatic efficiency ratio at each suction flow rate of the mixed-flow compressor according to the present embodiment. The reference value is defined by regarding as 1.0 the maximum value of the adiabatic efficiency of the mixed-flow compressor according to the present embodiment. As is apparent from FIG. 4, it is possible to considerably improve the adiabatic efficiency ratio in comparison with the conventional mixed-flow compressor having the diffuser without vanes.

As described above, since according to the present embodiment, it is possible to prevent the separation of the flow at the curved portion of the diffuser, it is possible to considerably reduce the loss at the curved portion and to make uniform the flow in the widthwise direction at the outlet portion of the guide vanes, thereby largely enhancing the performance of the diffuser after the outlet portion of the guide vanes. In addition, since the meridional flow passage of the diffuser is curved to the radial direction, the length of the flow passage may be reduced in comparison with that of the conventional mixed-flow diffuser and the frictional loss may also be reduced. As a result, the performance of the mixed-flow compressor may be largely enhanced in comparison with the conventional compressor. Furthermore, since the rotary shaft of the compressor may be shortened, the critical speed of the rotor may be increased.

Figure 5:
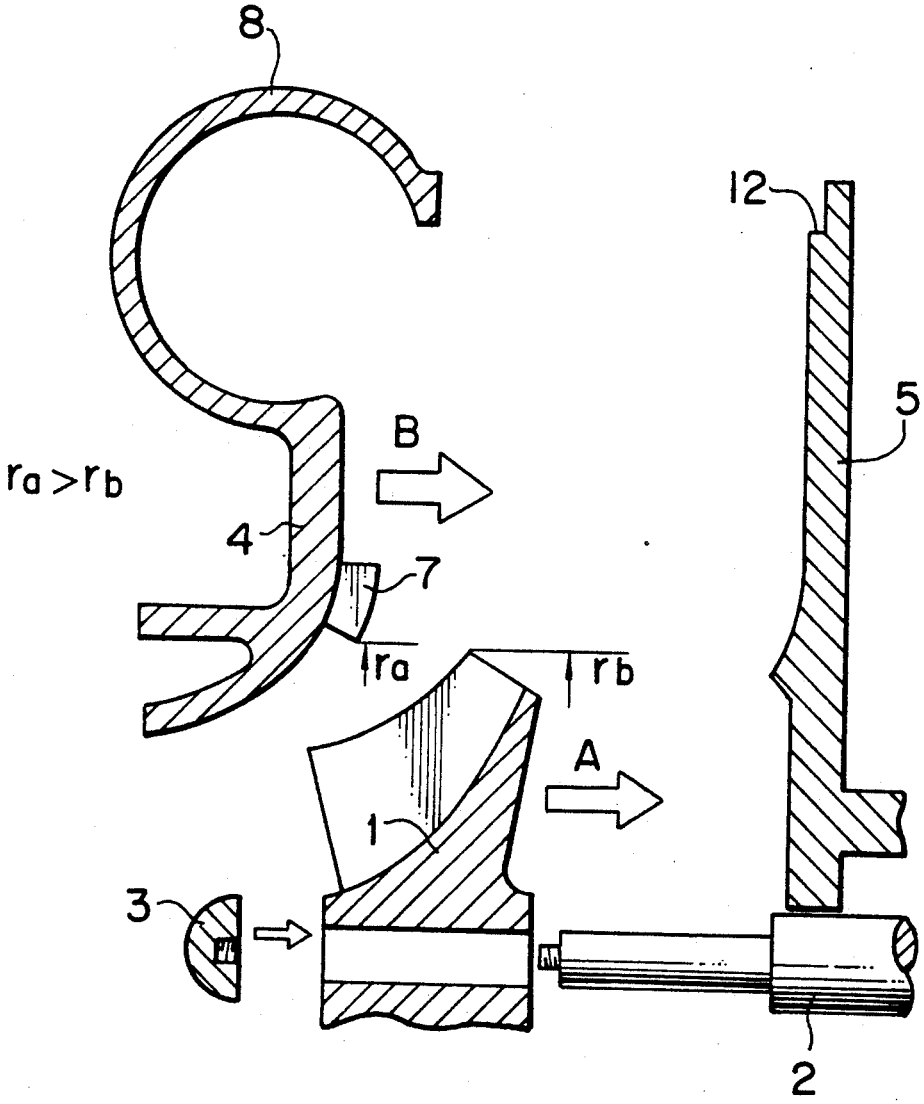
FIG. 5 is an assemblage illustration of the compressor shown in FIG. 1.

FIG. 5 is an illustration of the assemblage of the compressor of the embodiment shown in FIG. 1. First of all, the mixed-flow impeller 1 is fitted with the rotary shaft 2 by moving the impeller in the axial direction as indicated by the arrow A. Then, the impeller 1 is fastened to the rotary shaft 2 by the nut 3. The casing 8 integral with the diffuser plate 4 on which the guide vanes 7 are mounted is moved in the axial direction as indicated by the arrow B and is inserted into a fit portion 12 of the diffuser plate 5 which has been coupled with the rotary shaft 2 through bearings. In this embodiment, since the minimum inlet diameter of the guide vanes 7 is larger than the maximum outlet diameter of the impeller 1, it is also advantageously easy to assemble the compressor.

Figure 6:
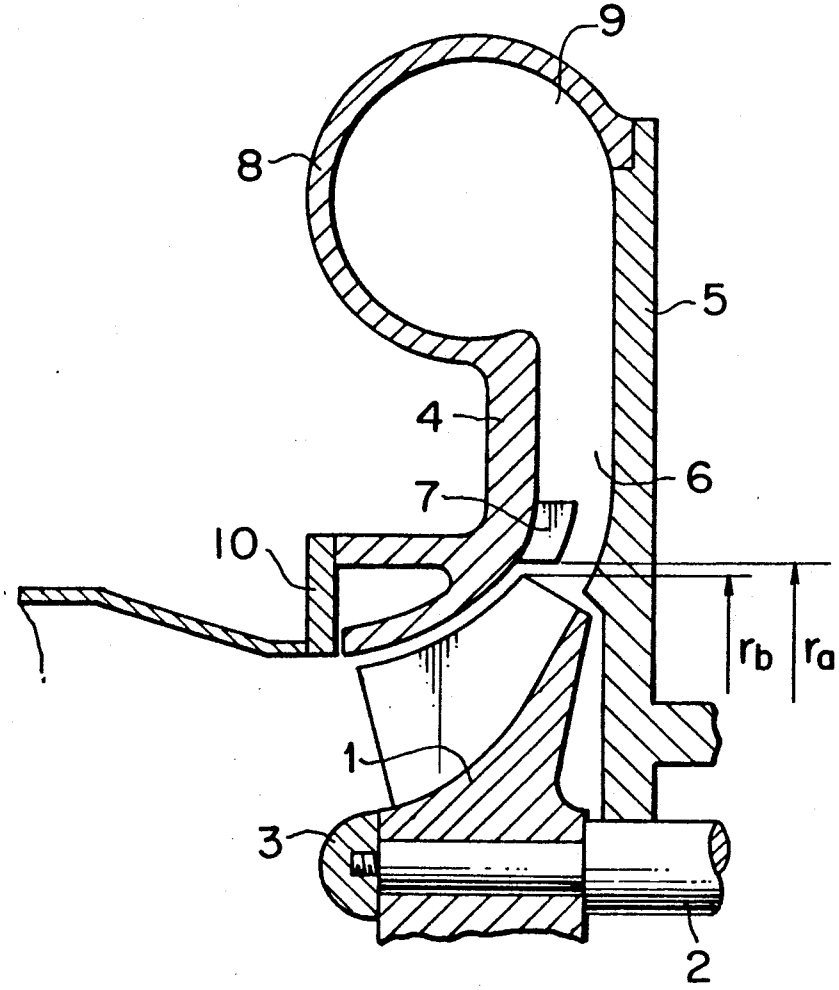
FIG. 6 is a longitudinal sectional view showing another embodiment of the invention.

FIG. 6 is a longitudinal view showing another embodiment. In this embodiment, in the same way as FIG. 1, the diffuser 6 is composed of a pair of diffuser plates 4 and 5 each having a curvature in the meridional plane and guide vanes 7 arranged in the form of a circular cascade at the curved portion on the flow passage surface of the diffuser plate 4. The inlet angle and the outlet angle of the guide vanes 7 are substantially equal to an impeller outlet average flow angle at the design point. Also, for the same reason as that in FIG. 1, the height of the guide vanes 7 is ranged in 20 to 50% of the flow passage width. Then, the inlet radius $r_a$ of the guide vanes 7 is larger than the outlet maximum radius $r_b$ of the impeller 1 and is kept constant.

Also in this mixed-flow compressor, in the same manner as in FIG. 1, the fluid on the side of the diffuser plate 4 at the outlet of the mixed-flow impeller is led by the guide vanes 7 without separating away from the wall surface and reaches the outlet of the curved portion. The flow is kept substantially constant in the widthwise direction at the outlet of the curved position. Accordingly, in the same manner as in FIG. 1, the performance of the diffuser 6 is considerably enhanced. Furthermore, since the meridional flow passage is curved to the radial direction, the axial length of the compressor is shortened. Therefore, also in this embodiment, it is possible to make the mixed-flow compressor small in size and it is also possible to increase the critical speed of the rotor.

Furthermore, since the inlet radius of the guide vanes 7 is larger than the maximum outlet radius of the impeller 1 and kept constant, it is possible to facilitate the assemblage of the compressor and easier to manufacture the diffuser than the case of FIG. 1.

Figure 7:
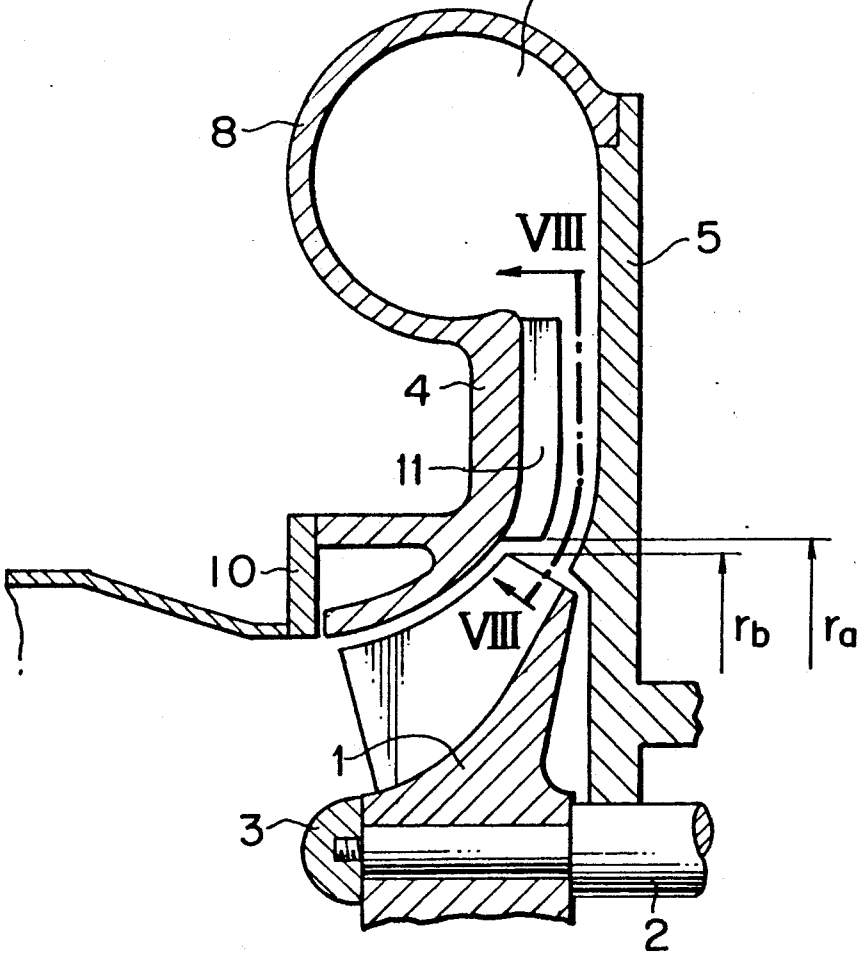
FIG. 7 is a longitudinal sectional view showing still another embodiment of the invention.
Figure 8:
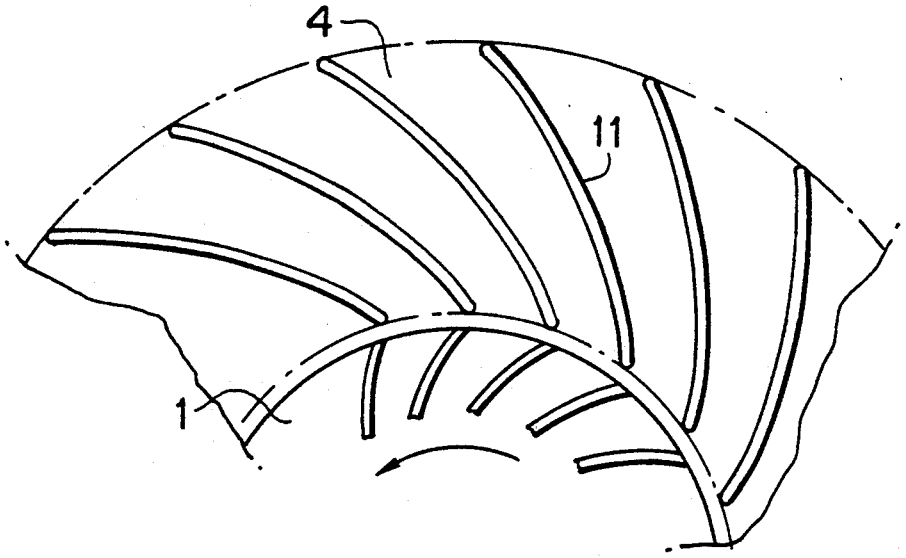
FIG. 8 is a cross-sectional view taken along the line VIII—VIII of FIG. 7.

FIG. 7 is a longitudinal sectional view showing still another embodiment. FIG. 8 is a cross-sectional view taken along the line VIII—VIII of FIG. 7. In this embodiment, in the same way as in FIG. 1, the diffuser 6 is composed of a pair of diffuser plates 4 and 5 each having a curvature in the meridional plane and guide vanes 11 arranged in the form of a circular cascade on the flow passage surface of the diffuser plate 4. The guide vanes 11 are provided not only on the curved portion of the flow passage surface of the diffuser plate 4 but also on the parallel portion downstream of the curved portion. The inlet and outlet angles are substantially equal to the average flow angle of the outlet of the impeller 1 at the design point. Also, for the same reason as that of FIG. 1, the height of the guide vanes 11 is ranged to be at 20 to 50% of the flow passage width. The inlet radius $r_a$ of the guide vanes 11 is larger than the outlet maximum radius $r_b$ of the impeller 1 and is kept constant.

Also in this mixed-flow compressor, in the same manner as in FIG. 1, the fluid on the side of the diffuser plate 4 at the outlet of the mixed-flow impeller 1 is led by the guide vanes 11 without separating away from the flow passage surface and reaches the outlet of the curved portion. At the outlet of the curved portion, the flow is made substantially uniform in the widthwise direction. However, in the case where no guide vanes 11 are provided at the parallel portion downstream of the curved portion, it is possible that the distortion of inlet flow is increased toward the downstream side. Accordingly, since the guide vanes 11 are provided to extend to the parallel portion to thereby keep uniform the flow along the parallel portion, it is also possible to enhance the diffuser performance, i.e., the performance of the mixed-flow compressor in comparison with the case shown in FIG. 1.

Incidentally, in this embodiment, since the meridional flow passage of the diffuser 6 is curved to the radial direction, the axial length of the compressor may be reduced. It is therefore possible to make small the mixed-flow compressor and to increase the critical speed of the rotor also in this embodiment.

Furthermore, since the inlet radius of the guide vanes 11 is larger than the outlet maximum radius of the impeller 1 in the same manner as in FIG. 6, it is possible to facilitate the assemblage of the compressor according to this embodiment, and it is possible to facilitate the manufacture of the diffuser in comparison with the case of FIG. 1.

Figure 9:
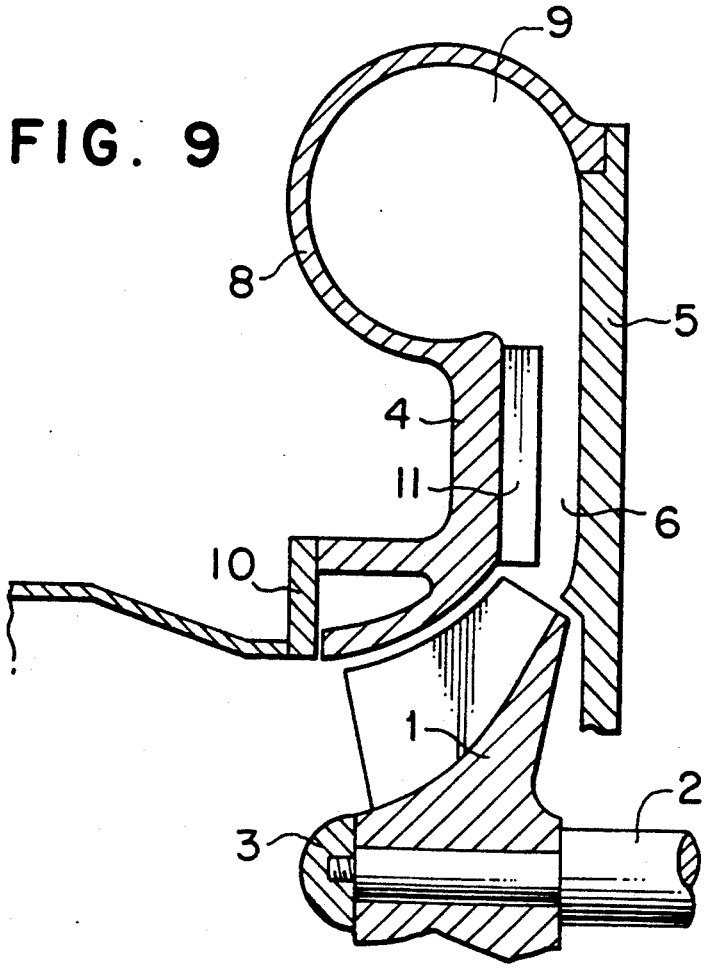
FIG. 9 is a longitudinal sectional view showing still another embodiment of the invention.

FIG. 9 is a longitudinal sectional view according to still another embodiment. In this embodiment, the diffuser 6 is composed of a diffuser plate 5 having a curvature in the meridional plane, a diffuser plate 4 bent to the radial direction immediately after the inlet thereof, and guide vanes 11 arranged in the form of a circular cascade on the flow passage surface of the diffuser plate 4. The guide vanes 11 are provided at a section between the inlet and outlet of the diffuser 6. The inlet and outlet angles are substantially the same as the average flow angle of the outlet of the impeller at the design point. Also, for the same reason as that of FIG. 1, the height of the guide vanes 11 is in the range of 20 to 50% of the flow passage width. The inlet radius $r_a$ of the guide vanes 11 is larger than the outlet maximum radius $r_b$ of the impeller 1 and is kept constant in the widthwise direction.

Also, in this mixed-flow compressor, in the same manner as in FIG. 1, since the fluid on the side of the diffuser plate 4 at the outlet of the mixed-flow impeller 1 is led by the guide vanes 11 without separating way from the flow passage surface, the flow within the diffuser is kept substantially uniform in the widthwise direction. Accordingly, the performance of the diffuser 6 is largely improved. Furthermore, since the meridional plane flow passage of the diffuser 6 is curved to the radial direction immediately after the inlet, the axial length of the compressor is shorter than that shown in FIG. 1. Accordingly, it is possible to make smaller the mixed-flow compressor and to increase the critical speed of the rotor in this embodiment.

In addition, since the inlet radius of the guide vanes 11 is larger than the outlet maximum radius of the impeller 1 and is kept constant, it is possible to facilitate the assemblage of the compressor and to simplify the manufacture of the diffuser in comparison with the case of FIG. 1.

What is claimed is:

1. In a mixed-flow compressor having a mixed-flow impeller in which a flow-out direction in a meridional plane of the impeller is leaned from a radial direction, and a pair of diffuser plates provided downstream of the mixed-flow impeller, wherein a diffuser flow passage is identical with the flow-out direction of said mixed-flow impeller at an inlet portion and is directed to the radial direction at an outlet portion, the improvement comprising:

a diffuser with a diffuser flow passage which is curved to the radial direction in the vicinity of the outlet of said mixed-flow impeller, and guide vanes each having a height, defined by a projection into the diffuser flow passage in a direction substantially transverse to the direction of flow, such that a minimum inlet radius thereof is larger than a maximum radius at the outlet of said mixed-flow impeller, wherein the guide vanes are arranged in the form of a circular cascade at the curved portion on a flow passage surface of a diffuser plate located on a shroud side.

2. The compressor according to claim 1, wherein an inlet angle and an outlet angle of said guide vanes are equal to an average flow angle of the outlet of said mixed-flow impeller at a design point.

3. The compressor according to claim 2, wherein the height of said guide vanes is ranged to be at 20 to 50% of a width of the flow passage.

4. The compressor according to claim 3, wherein a radius of an inlet of said guide vanes is kept constant.

5. The compressor according to claim 2, wherein a radius of an inlet of said guide vanes is kept constant.

6. The compressor according to claim 1, wherein the height of said guide vanes is ranged to be at 20 to 50% of a width of the flow passage.

7. The compressor according to claim 6, wherein a radius of an inlet of said guide vanes is kept constant.

8. The compressor according to claim 1, wherein a radius of an inlet of said guide vanes is kept constant.

9. In a mixed-flow compressor having a mixed-flow impeller in which a flow-out direction in a meridional plane of the impeller is leaned from a radial direction, and a pair of diffuser plates provided downstream of the mixed-flow impeller, wherein a diffuser flow passage is identical with the flow-out direction of said mixed-flow impeller at an inlet portion and is directed to the radial direction at an outlet portion, the improvement comprising:

a diffuser with a diffuser flow passage which is curved to the radial direction in the vicinity of the outlet of said mixed-flow impeller, and guide vanes each having a height, defined by a projection into the diffuser flow passage in a direction substantially transverse to the direction of flow, such that a minimum inlet radius thereof is larger than a maximum radius at the outlet of said mixed-flow impeller, wherein the guide vanes are arranged in the form of a circular cascade over the whole flow passage surface of the diffuser plate located on a shroud side.

10. The compressor according to claim 9, wherein an inlet angle and an outlet angle of said guide vanes are equal to an average flow angle of the outlet of said mixed-flow impeller at a design point.

11. The compressor according to claim 10, wherein the height of said guide vanes is ranged to be at 20 to 50% of a width of the flow passage.

12. The compressor according to claim 11, wherein a radius of an inlet of said guide vanes is kept constant.

13. The compressor according to claim 10, wherein a radius of an inlet of said guide vanes is kept constant.

14. The compressor according to claim 9, wherein the height of said guide vanes is ranged to be at 20 to 50% of a width of the flow passage.

15. The compressor according to claim 14, wherein a radius of an inlet of said guide vanes is kept constant.

16. The compressor according to claim 9, wherein a radius of an inlet of said guide vanes is kept constant.

17. In a mixed-flow compressor having a mixed-flow impeller in which a flow-out direction in a meridional plane of the impeller is leaned from a radial direction, and a pair of diffuser plates provided downstream of the mixed-flow impeller, wherein a diffuser flow passage is identical with the flow-out direction of said mixed-flow impeller at an inlet portion and is directed to the radial direction at an outlet portion, the improvement comprising:

a diffuser with a diffuser flow passage which is curved radially on a part thereof immediately after an outlet portion of aid mixed-flow impeller; and guide vanes each having a height, defined by a projection into the diffuser flow passage in a direction substantially transverse to the direction of flow, such that a minimum inlet radius thereof is larger than a maximum radius at the outlet of said mixed-flow impeller, wherein the guide vanes are arranged in the form of a circular cascade over the whole flow passage surface of the diffuser plate located on a shroud side.

18. The compressor according to claim 17, wherein an inlet angle and an outlet angle of said guide vanes are equal to an average flow angle of the outlet of said mixed-flow impeller at a design point.

19. The compressor according to claim 18, wherein the height of said guide vanes is ranged to be at 20 to 50% of a width of the flow passage.

20. The compressor according to claim 19, wherein a radius of an inlet of said guide vanes is kept constant.

21. The compressor according to claim 18, wherein a radius of an inlet of said guide vanes is kept constant.

22. The compressor according to claim 17, wherein the height of said guide vanes is ranged to be at 20 to 50% of a width of the flow passage.

23. The compressor according to claim 22, wherein a radius of an inlet of said guide vanes is kept constant.

24. The compressor according to claim 17, wherein a radius of an inlet of said guide vanes is kept constant.

* * * * *